US009970600B1

(12) United States Patent
Donnan

(10) Patent No.: US 9,970,600 B1
(45) Date of Patent: May 15, 2018

(54) LIGHT STICK

(71) Applicant: Railhead Corporation, Alsip, IL (US)

(72) Inventor: Joseph Donnan, Burr Ridge, IL (US)

(73) Assignee: Railhead Corporation, Burr Ridge, IL (US)

( * ) Notice: Subject to any disclaimer, the term of this patent is extended or adjusted under 35 U.S.C. 154(b) by 0 days. days.

(21) Appl. No.: 15/716,765

(22) Filed: Sep. 27, 2017

Related U.S. Application Data

(60) Provisional application No. 62/403,249, filed on Oct. 3, 2016.

(51) Int. Cl.

| | |
|---|---|
| ***F21S 4/00*** | (2016.01) |
| ***F21K 9/237*** | (2016.01) |
| ***B61L 5/18*** | (2006.01) |
| ***F21K 9/66*** | (2016.01) |
| ***F21K 9/235*** | (2016.01) |
| ***F21K 9/238*** | (2016.01) |

(52) U.S. Cl.
CPC ..... *F21K 9/237* (2016.08); *B61L 5/18* (2013.01); *F21K 9/235* (2016.08); *F21K 9/238* (2016.08); *F21K 9/66* (2016.08)

(58) Field of Classification Search
USPC ..... 362/225, 217.1
See application file for complete search history.

(56) References Cited

U.S. PATENT DOCUMENTS 9,759,392 B2 * 9/2017 Timmermans ..... F21K 9/278

* cited by examiner

*Primary Examiner* — Vip Patel
(74) *Attorney, Agent, or Firm* — Doherty, Wallace, Pillsbury & Murphy P.C.

(57) ABSTRACT

A light stick, primarily useful in the locomotive industry for signally between train personnel, includes a longitudinally extending housing which contains a first light source and a second light source. The first light source provides for general purpose illumination of the light stick. The second light source provides illumination primarily for purposes of signaling. The light stick may include a lens cap which is positioned at a forward end of the housing, and from which the illumination from the second light source may extend. Preferably, the light that is emitted from the lens cap has a blue color for purposes of railroad signaling.

10 Claims, 7 Drawing Sheets

LIGHT STICK

BACKGROUND OF THE INVENTION

1. Field of the Invention

The present invention relates generally to signaling lanterns used in the railroad industry, and, more particularly, to a trainman's lantern having both axially and radially directed illumination.

2. Background of the Invention

Trainman's lanterns are specialized lighting apparatus used in the railroad industry for purposes of both signaling and illumination. In particular, trainman's lanterns are used to transmit signals from the brakeman or switchman to the engineer in the locomotive, when coupling/uncoupling cars, moving on to switches and sidings, and so on. Modern lanterns have their origins in the oil lanterns of the nineteenth century, and so many of the signals now in use (e.g., swinging the lantern through an arc with the arm lowered) were developed on this basis, with the limitation that the lantern needed to be held generally upright. Still other signals evolved with the later adoption of electric lanterns. Furthermore, in addition to signaling, the trainman's lantern must provide general purpose illumination so that the brakeman can read numbers and information on the cars, to see when walking on the crushed rock ballast, and so on.

This combination of functions has given rise to certain design requirements. First, the lantern must project a degree of illumination in a lateral direction that will be visible to the engineer when the lantern is held in a vertical orientation. It must also have a concentrated "spot" beam that can be used for other signaling as well as for general purpose illumination.

One example of a previous trainman's lantern having these characteristics is the Starlite™ model 292, available from Star Headlight & Lantern. Company, Honeoye Falls, N.Y., USA, This lantern has a battery case that is supported from a hail, with two incandescent bulbs being mounted at the lower end of the case. The first bulb is mounted within a small parabolic reflector covered by a clear shield, similar to a conventional flashlight. The second bulb protrudes from the end of the case and is exposed so that it can be seen from the sides; a ring projects below the case on struts to protect the exposed bulb from damage.

Although they meet the foregoing requirements (i.e., illumination and signaling) in a general sense, prior lanterns of this type have not been wholly satisfactory. The single exposed bulb is non-directional, and when viewed from the side is inadequately bright to be seen by the engineer at long distances (e.g., at the end of a long train); moreover, at certain angles light from the bulb is blocked by the protective struts. However, using additional bulbs for greater brightness and visibility is not a viable solution due to increased drain on the battery. The lanterns are often kept lit throughout nighttime hours, so that using additional bulbs would mean that in many instances the battery would be dead before the end of the shift, Even with existing two-bulb lanterns, each operating region of a major railroad consumes several thousand batteries every night, at considerable cost.

Other deficiencies of traditional trainman's lanterns include a weak and poorly distributed main "spot" beam and inadequate durability. For example, the struts that support the guard ring around the bottom of the lantern described above must be relatively narrow in order to avoid even worse blockage of the bulb, so that the protective cage is relatively fragile and is smashed with alarming regularity.

Another problem with the prior art is that traditional trainsman's lanterns are heavy and cumbersome. These lanterns are designed with large bail handles which allow an operator to slide the lantern down the operator's arm as the operator climbs onto a car or locomotive, which is physically uncomfortable, thereby causing the operator to hold the lantern in the operator's hand, thereby leaving only one hand available to support the operator as he climbs onto the car or locomotive, which poses an obvious safety risk to the operator. Additionally, traditional lanterns use a 6-volt spring terminal battery which add to the weight of the conventionally known lanterns in a significant manner as such batteries oftentimes add up to about 1 pound in weight.

Accordingly, there exists a need for a trainman's lantern that provides an effective lateral degree of illumination for signaling when held in a vertical orientation. Furthermore, there exists a need for such a trainman's lantern that provides such illumination with sufficient brightness that is visible at extended distances. Still further, there exists a need for such a lantern that provides such illumination without excessive battery drain. Still further, there exists a need for such a lantern that provides a bright, well-distributed main, "spot" beam for purposes of both illumination and signaling. Still further, there exists a need for such a trainman's lantern that is durable and resistant to breakage in normal operating conditions and which can be held easily and efficiently without the need of the traditionally used bail.

BRIEF SUMMARY OF THE INVENTION

A light stick, primarily useful in the locomotive industry for signally between train personnel, includes a longitudinally extending housing which contains a first light source and a second light source. The first light source, which is disposed on a top side of the housing and which extends therefrom to a midline of a proximal lateral wall and to a midline of an oppositely situated distal lateral wall of the housing, provides for general purpose illumination of the light stick. The second light source, which is positioned towards a forward end of the housing, provides illumination for purposes of signaling. The light stick includes a lens cap, which is positioned at a forward end of the housing, and from which the illumination from the second light source may extend. Preferably, the light that is emitted from the lens cap has a blue color.

These and other features and advantages of the present invention will be more fully understood from a reading of the following detailed description with reference to the accompanying drawings.

DETAILED DESCRIPTION OF THE INVENTION

Figure 1:
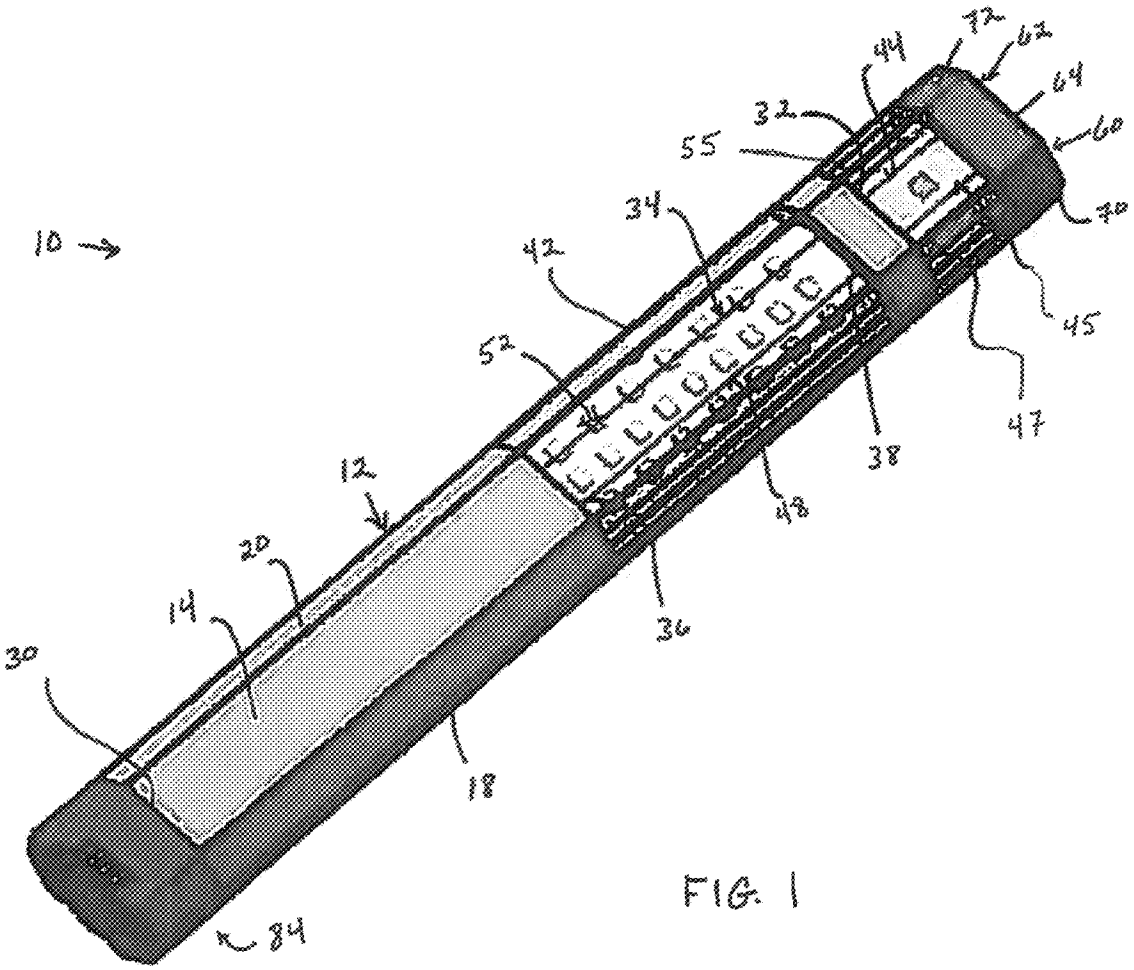
FIGS. 1 and 2 are schematic depicting an elevational top side view of an exemplary light stick.
Figure 2:
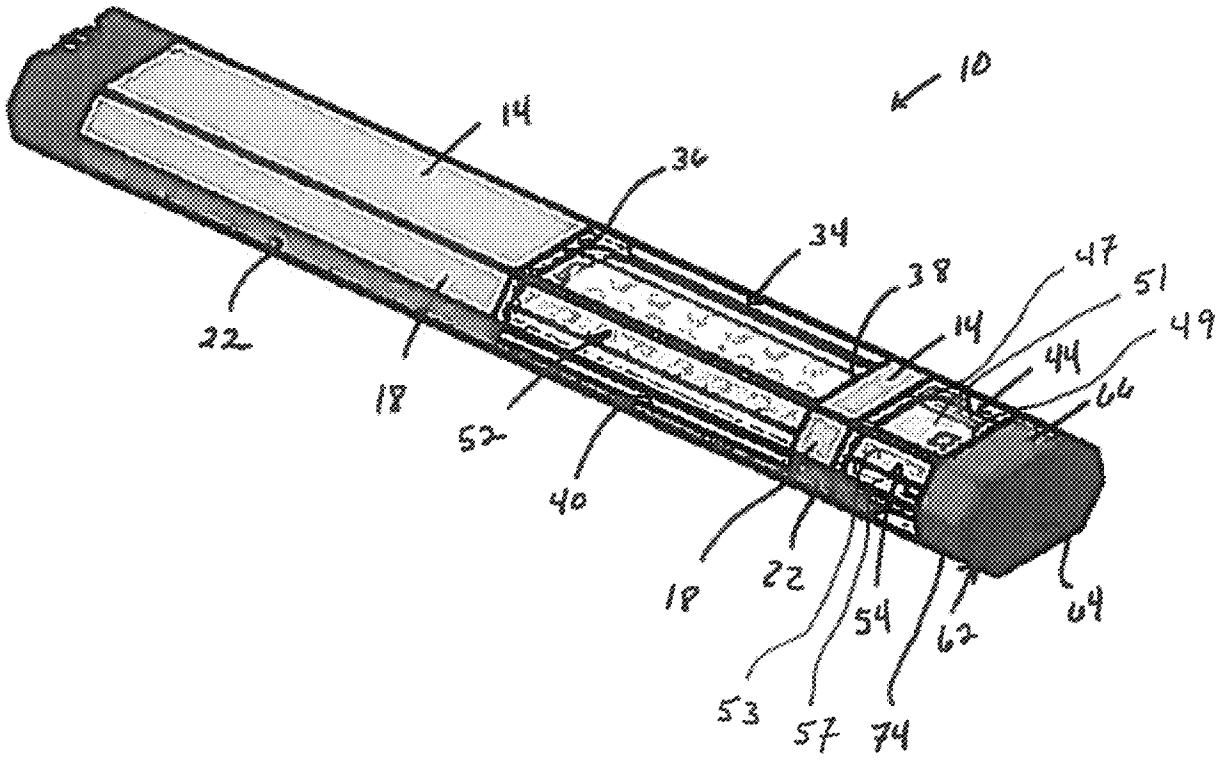
Figure 3:
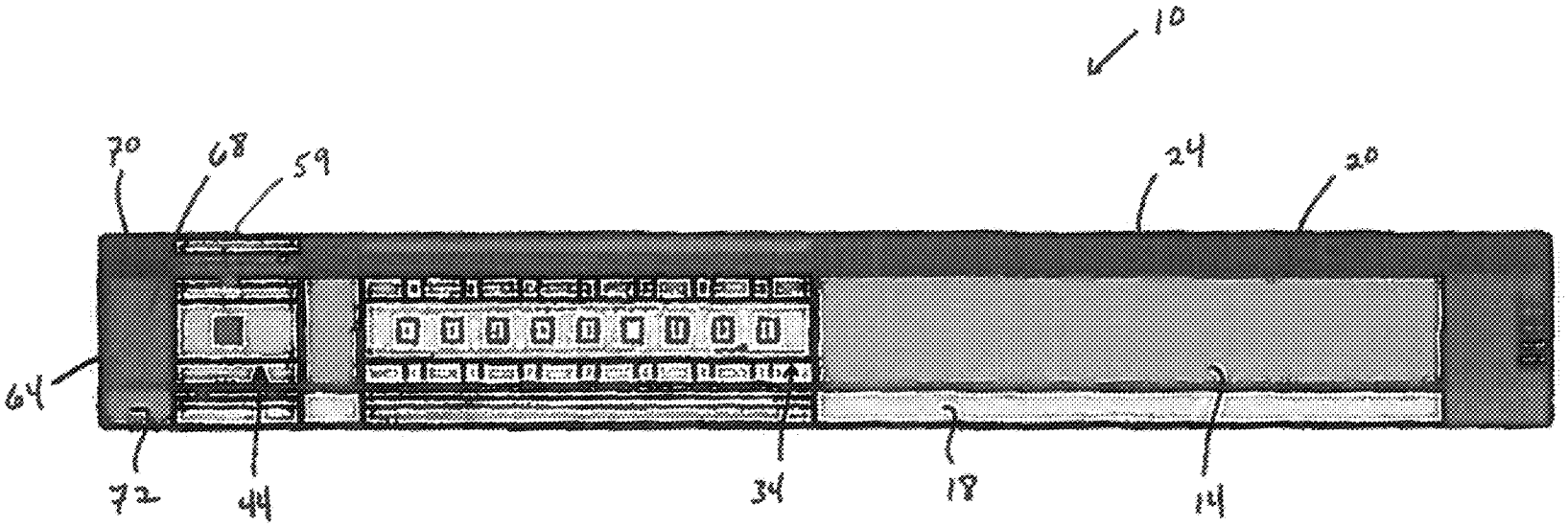
FIG. 3 is a schematic depicting a top side view of the lights tick depicted in FIG. 1.

Preferred embodiments of the present disclosure will he described hereinbelow with reference to the accompanying drawings. In the following description, well-known functions or constructions are not described in detail to avoid obscuring the invention in unnecessary detail. Throughout the drawings, like reference numerals represent like elements.

Referring to FIGS. 1-8, a light stick 10 according to an embodiment of the present disclosure is shown. Referring to FIGS. 1-6, light stick Its comprises a housing 12 having an octagonal shaped body which extends along a longitudinal Y axis. To that end, housing 12 has a top side 14 oppositely situated to a bottom side 16, an upper proximal lateral side 18 oppositely situated to an upper distal lateral side 20, a medial proximal lateral side 22 oppositely situated to a medial distal lateral side 24, and a lower proximal lateral side 26 oppositely situated to a lower distal lateral side 28. Upper proximal and distal lateral sides 18 and 20 are contiguously formed with top side 14 and with respective medial proximal and distal lateral sides 22 and 24, Lower proximal and distal lateral sides 26 and 28 are contiguously formed with bottom side 16 and with respective medial proximal and distal lateral sides 22 and 24. All of top side 14, bottom side 16, upper proximal and distal lateral sides 18 and 20, medial proximal and distal lateral sides 22 and 24, and lower proximal and distal lateral sides 26 and 28 terminate at a rearward end 30 and at an oppositely situated forward end 32.

A chamber (not shown) longitudinally extends along longitudinal axis Y, and is centrally formed through housing 12 and is surrounded by top side 14, bottom side 16, upper proximal and distal lateral sides 18 and 20, medial proximal and distal lateral sides 22 and 24, and lower proximal and distal lateral sides 26 and 28.

A window 34 is formed though top side 14, upper proximal and distal lateral sides 18 and 20, medial proximal lateral side 22, and lower proximal lateral side 26 and extends into the chamber. Window 34 is defined by a lower edge 36 oppositely situated to an upper edge 38, and a proximal edge 40 oppositely situated to a distal, edge 42. Lower edge 36 is formed at an approximate midsection of housing 12, proximal edge 40 is formed centrally through medial proximal lateral side 22 and runs parallel therewith, distal edge 42 is formed through medial distal lateral side 24, and upper edge 38 is formed rearward of forward end 32.

Light stick 10 comprises a transparent cover 48 that covers window 34, and which serves to close off the space existing between cover 48 and housing 12. In an exemplary embodiment cover 48 is integrally formed with housing 12 and, therefore, housing 12 and cover 48 preferably form a single unit, Nevertheless, cover 48 alternatively may be separately formed from housing 12, and may be attached to housing, for example, by a snap fit mechanism.

Light stick 10 further comprises a translucent cover 44, Cover 44 has a body 45 which terminates at a rearward end 47 and at an oppositely situated forward end 49. Body 45 further comprises a top side 51, an upper proximal lateral side 53, an upper distal lateral side 55, a medial proximal lateral side 57, a medial distal lateral side 59, a lower proximal lateral side 61, a lower distal lateral side 63, and a bottom side 65, wherein sides 51, 53, 55, 57, 59, 61, 63, and 65 surround a chamber (not shown).

Rearward end 47 of cover 44 is attached to forward end 32 of housing 12 such that top side 51 is coaxial with top side 14, upper proximal lateral side 53 is coaxial with upper proximal lateral side 18, upper distal lateral side 55 is coaxial with upper distal lateral side 20, medial proximal lateral side 57 is coaxial with medial proximal lateral side 22, medial distal lateral side 59 is coaxial with medial distal lateral side 24, lower proximal lateral side 61 is coaxial with lower proximal lateral side 26, lower distal lateral side 63 is coaxial with lower distal lateral side 28, and bottom side 65 is coaxial with bottom side 16, and such that the chamber of housing 12 is in fluid communication with the chamber of cover 44.

In an exemplary embodiment cover 44 is integrally formed with housing 12 and, therefore, housing 12 and cover 44 preferably form a single unit. Nevertheless, cover 44 alternatively may be separately formed from housing 12, and may be attached to housing, for example, by a snap fit mechanism.

Referring primarily to FIGS. 1-3 and 6, light stick 10 comprises a first light source 52 which is contained within the chamber and which is protected and directly overlaid by cover 48. Although light source 52 may comprise a variety of types, sizes, and wattages of bulbs, in an exemplary embodiment, light source 52 comprises a plurality of light emitting diodes (LED). Preferably light source 52 emits a white colored light. Light source 52 is powered by a power source (not shown) which is contained within the chamber (not shown). The power source may comprise a power source which is conventionally known in the art, such as, for example, a battery such as, a AA or a AAA battery, and may be placed in electrical communication with light source 52 via conventionally known means.

Light stick 10 further comprises a second light source 54. Referring to FIGS. 1-6, light source 54 is contained within the chamber and is protected and surrounded by cover 44. Although light source 54 may comprise a variety of types, sizes, and wattages of bulbs, in an exemplary embodiment, light source 54 comprises a plurality of light emitting diodes (LED). Preferably light source 54 consists of blue and/or white LED lights. Light source 54 may be powered by the power source used to power light source 52, or, alternatively, it may be powered by a second power source which may be contained within the chamber of housing 12 and/or within the chamber of cover 44. When used, the second power source may comprise a power source that is conventionally known in the art, and may be placed in electrical communication with light source 54 via conventionally known means.

Figure 4:
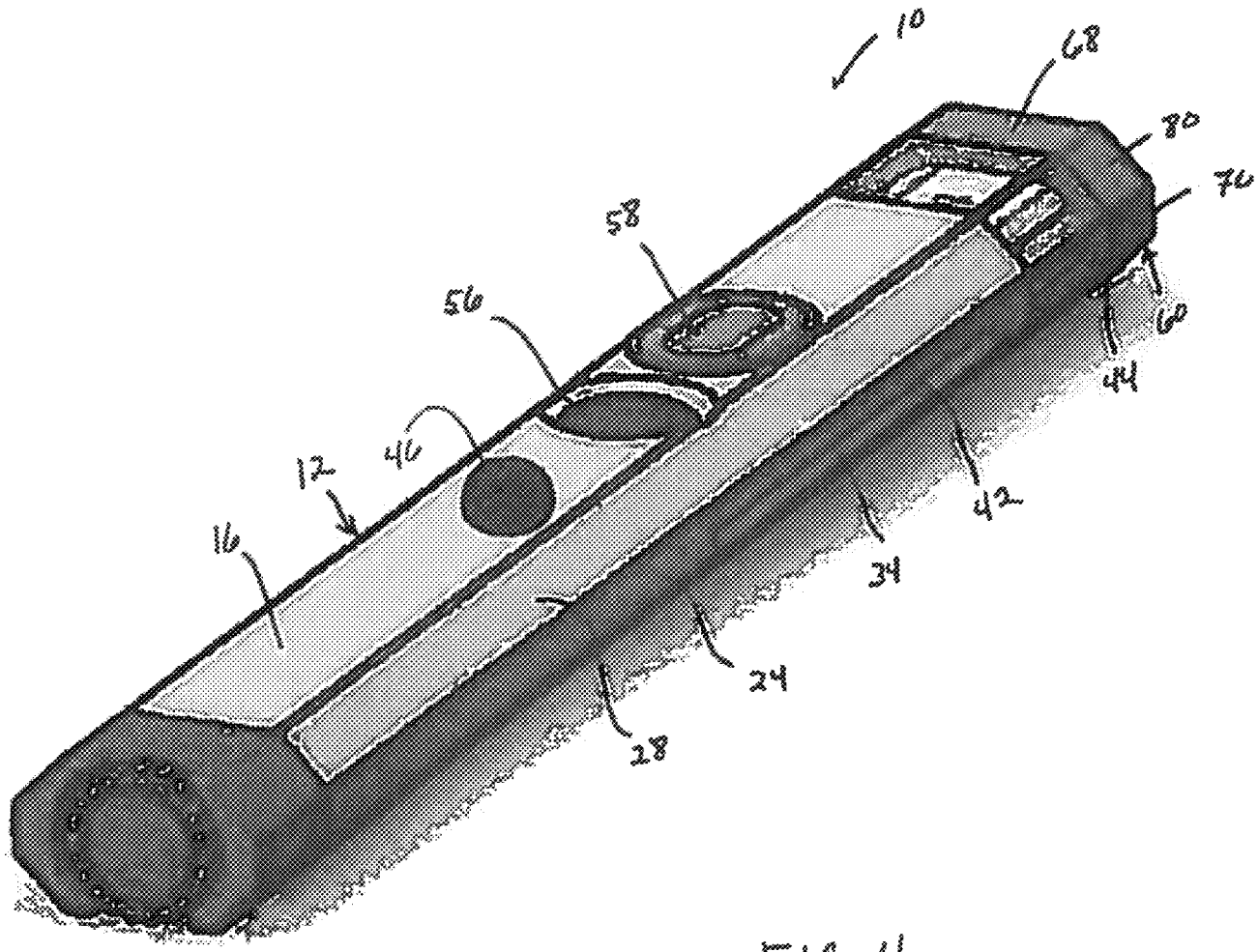
FIG. 4 is a schematic depicting an elevational bottom side view of the light stick depicting in FIG. 1.
Figure 5:
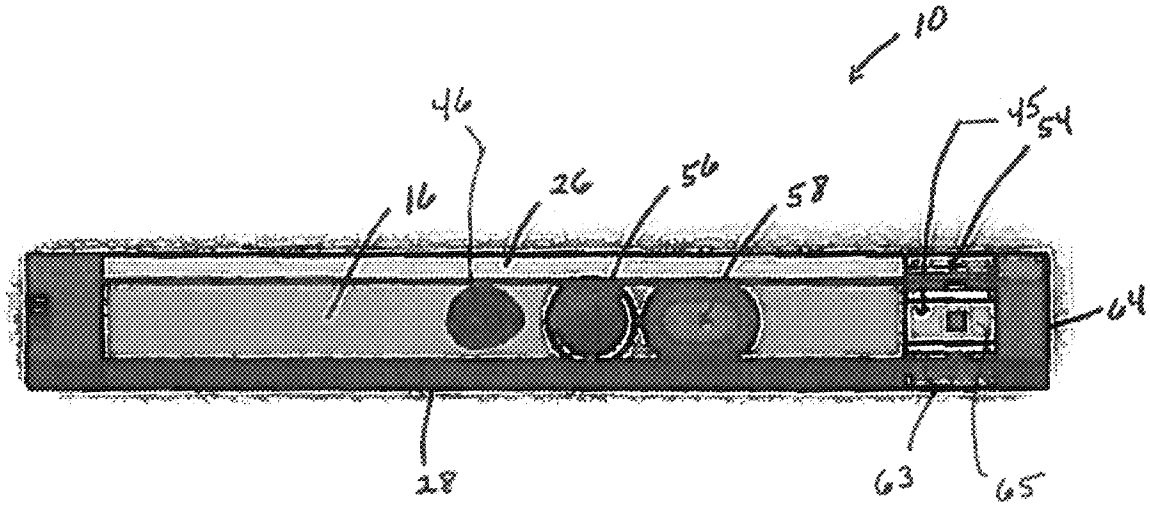
FIG. 5 is a schematic depicting a bottom side view of the light stick depicted in FIG. 1.
Figure 6:
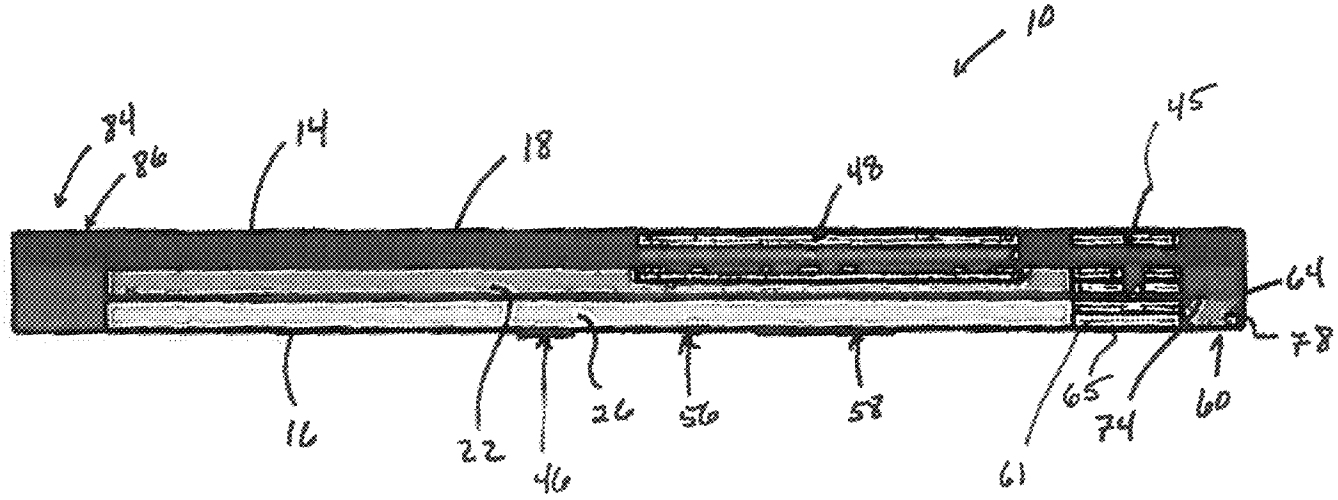
FIG. 6 is a schematic depicting a lateral view of the light stick depicted in FIG. 1.

Referring to FIGS. 4 and 5, light stick 10 further comprises a power switch 56 centrally located on bottom side 16 of housing 12. Power switch 56 is in electrical communication with light source 54 and serves as the means by which light source 54 is actuated, i.e., turned on, or de-actuated, i.e., turned off.

Light stick 10 further comprises a power switch 46 adjacently situated to power switch 56 on bottom side 16 of housing 12. Power switch 46 is in electrical communication with light source 52 and serves as the means by which light source 52 is actuated.

Light sources 52 and 54 are electrically communicated to respective power switches 46 and 56 and to their respective power source, such that both light sources 52 and 54 may be on at the same time or only one of light sources 52 and 54 may be on instead of the other of light sources 52 and 54 depending on the user's preferences and/or needs.

Light stick 10 also comprises a magnet 58 disposed on bottom side 16 of housing 12 and adjacently positioned to power switch 56 on a side thereof opposite to power switch 46. Magnet 58 holds light stick 10 to a magnetized material to thereby allow light stick 10 to be used in a hands free manner.

Referring to the figures, light stick 10 further comprises a lens cap 60. Lens cap 60 is disposed towards forward end 49 of cover 44, and, in an especially preferred embodiment is integrally formed with forward end 49, though it may be separately formed from forward end 49 in which case, lens cap 60 may be secured to forward end 49 by, e.g., a snap-fit mechanism, frictional lit, screws, and the like.

Figure 7:
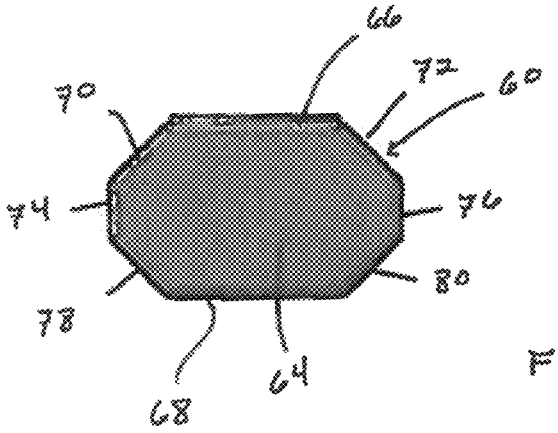
FIG. 7 is a schematic depicting a forward end of the light stick depicted in FIG. 1.

Referring to FIG. 7, lens cap 60 has a generally open-ended octagonal shaped body 62 comprising a forward face 64 from which a top side 66 and an oppositely situated bottom side 68, an upper proximal lateral side 70 and an oppositely situated upper distal lateral side 72, a medial proximal lateral side 74 and an oppositely situated medial distal lateral side 76, and a lower proximal lateral side 78 and an oppositely situated lower distal lateral side 80 perpendicularly extend. Lens cap 60 includes a cavity (not shown) which is surrounded by body 62. Top side 66 is coaxial with and connected to top side 51, upper proximal lateral side 70 is coaxial with and connected to upper proximal lateral side 53, upper distal lateral side 72 is coaxial with and connected to upper distal lateral side 55, medial proximal lateral side 74 is coaxial with and connected to medial proximal lateral side 57, medial distal lateral side 76 is coaxial with and connected to medial distal lateral side 59, lower proximal lateral side 78 is coaxial with and connected to lower proximal lateral side 61, lower distal lateral side 80 is coaxial with and connected to lower distal lateral side 63, and bottom side 68 is coaxial with and connected to bottom side 65 such that the cavity of lens cap 60 is directed towards forward end 49 of cover 44.

To conform with the railroad's standards of using blue light signals to ensure that the locomotive is not moved when operating personnel are maintaining or repairing the locomotive, lens cap 60 is translucent and is preferably blue in color. In this manner, then, light stick 10 provides a means whereby train operators can follow the blue light safety procedure as such a procedure is conventionally known in the industry.

Referring to the figures, light stick 10 further comprises an end cap 84. End cap 84 is disposed on rearward end 30 of housing 12, and, in an especially preferred embodiment is integrally formed with rearward end 30, though it may be separately formed from rearward end 30 in which case, end cap 84 may be secured to rearward end 30 by, e.g., a snap-fit mechanism, frictional fit, screws, and the like.

Figure 8:
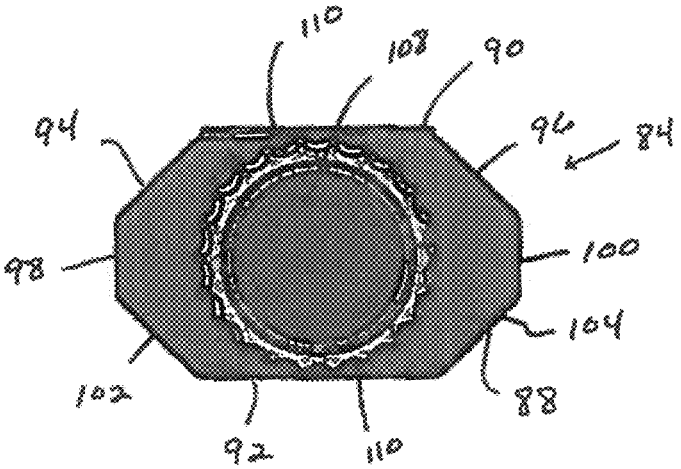
FIG. 8 is a schematic depicting a rearward end of the light stick depicted in FIG. 1.

Referring to FIG. 8, end cap 84 has a generally open-ended octagonal shaped body 86 comprising a rearward face 88 from which a top side 90 and an oppositely situated bottom side 92, an upper proximal lateral side 94 and an oppositely situated upper distal lateral side 96, a medial proximal lateral side 98 and an oppositely situated medial distal lateral side 100, and a lower proximal lateral side 102 and an oppositely situated lower distal lateral side 104 perpendicularly extend. End cap 84 includes a cavity (not shown) which is surrounded by body 86. Top side 90 is coaxial with and connected to top side 14, upper proximal lateral side 94 is coaxial with and connected to upper proximal lateral side 18, upper distal lateral side 96 is coaxial with and connected to upper distal lateral side 20, medial proximal lateral side 98 is coaxial with and connected to medial proximal lateral side 22, medial distal lateral side 100 is coaxial with and connected to medial distal lateral side 24, lower proximal lateral side 102 is coaxial with and connected to lower proximal lateral side 26, lower distal lateral side 104 is coaxial with and connected to lower distal lateral side 28, and bottom side 92 is coaxial with and connected to bottom aide 16 such that the cavity of end cap 84 is directed towards rearward end 30 of housing 12.

Rearward face 88 has an opening (not shown) centrally formed therethrough, wherein the opening extends into the chamber (not shown). End cap 84 further has a generally circular shaped dial 108 centrally positioned on and/or through rearward face 88, wherein dial 108 is positioned directly over the opening and thereby conceals the opening. Dial 108 has a plurality of alternating grooves and ridges 110 wherein plurality 110 assists in the turning of dial 108 in either a clockwise or counterclockwise direction to thereby open or close dial 108. When dial 108 is in an open position, dial 108 may be removed from end cap 84 thereby revealing the opening and making the chamber accessible. A battery (not shown), such as a AA or a AAA battery, may be placed in chamber via the opening when dial 108 is open, and the battery may be secured thereto by closing dial 108 over the opening. End cap 84, includes components, as are conventionally known, that are in electrical communication with the battery, with power switches 56 and 46, and with light sources 52 and 54.

When in use, the light stick, as shown and described herein, provides a means whereby train personnel effectively can communicate with and signal to one another. The first light source is positioned within the housing of the light stick to provide a sufficient amount and area of illumination to thereby assist the train personnel in conducting general operations. The second light source provides a means whereby the train personnel can effectively signal to other train personnel. The housing of the light stick provides a means whereby a user can easily hold and manipulate the light stick. The magnet provides a means whereby the light stick can be stored when not in use, or by which a user can suspend the light stick when the user needs a hands free option when using the light stick. The blue light feature of the light stick provides a means whereby an operator can follow the blue light safety procedure when the locomotive is being maintained or repaired.

While the disclosure has been shown and described with reference to certain preferred embodiments thereof, it will be understood by those skilled in the art that various changes in form and detail may be made therein without departing from the spirit and scope of the disclosure.

What is claimed is:

1. A light stick, comprising:

a housing having a longitudinally extending generally cylindrically-shaped body which terminates at a forward end on one end thereof and at a rearward end on an oppositely situated end thereof; wherein a window is formed through a top side, a proximal lateral side, and a distal lateral side of the body of the housing, wherein the proximal lateral side is oppositely situated to the distal lateral side of the body, and wherein each of the proximal and distal lateral sides are sloped relative to the top side, and further wherein the top side is oppositely situated to a bottom side;

a second window which extends through the top side of the housing and through a portion of the proximal lateral side and a portion of the distal lateral side of the housing;

a first translucent cover which covers the window and which is physically disposed on the proximal lateral side and the distal lateral sides of the body of the housing and which has a top side that is colinear with the top side of the body of the housing;

a first light source disposed within the window and between the body of the housing and the translucent cover;

a second translucent cover having a generally cylindrical shaped body which terminates at a rearward end at one end thereof and at a forward end at an oppositely situated end thereof, wherein the rearward end of the body of the second translucent cover is directed towards the forward end of the body of the housing, and wherein the body of the second translucent cover has a chamber formed therein; and a second light source disposed within the chamber of the second translucent cover.

2. The light stick of claim 1, wherein the body of the housing has a generally octagonal configuration.

3. The light stick of claim 1, wherein the second light comprises a blue colored light emitting source.

4. The light stick of claim 1, wherein each of the first and the second light sources comprises a light emitting diode.

5. The light slick of claim 1, further comprising a lens cap, wherein the lens cap is physically engaged with the forward end of the second translucent cover.

6. The light stick of claim 5, wherein the lens cap is integrally formed with the forward end of the second translucent cover.

7. The light stick of claim 1, further comprising an end cap directed towards the rearward end of the body of the housing, wherein the end cap receives a power source, wherein the power source provides power to actuate the first and second light sources.

8. The light stick of claim 7, wherein the end cap is physically engaged with the rearward end of the body of the housing.

9. The light stick of claim 1, further comprising a first power switch in electrical communication with the first light source and a second power switch in electrical communication with the second fight source, wherein the first and second power switches are disposed on the bottom side of the body of the housing.

10. The light stick of claim 9, further comprising a magnet disposed on the bottom side of the housing.

* * * * *